US006571528B1

(12) United States Patent
Crump, Jr.

(10) Patent No.: US 6,571,528 B1
(45) Date of Patent: Jun. 3, 2003

(54) MECHANICAL CONNECTOR BETWEEN HEADED STUDS AND REINFORCING STEEL

(75) Inventor: Jack S. Crump, Jr., Tampa, FL (US)

(73) Assignee: Universal Services, Inc., Tampa, FL (US)

( * ) Notice: Subject to any disclaimer, the term of this patent is extended or adjusted under 35 U.S.C. 154(b) by 29 days.

(21) Appl. No.: 10/033,851

(22) Filed: Dec. 20, 2001

(51) Int. Cl.[7] ..... E04C 5/16
(52) U.S. Cl. ..... 52/699; 52/719; 403/353
(58) Field of Search ..... 52/719, 686, 679, 52/682, 683, 698, 699, 703; 403/353

(56) References Cited

U.S. PATENT DOCUMENTS

| | | | |
|---|---|---|---|
| 1,086,732 | A | 2/1914 | Schoenthaler |
| 2,772,560 | A | 12/1956 | Neptune |
| 3,456,706 | A | 7/1969 | Ollis, Jr. |
| 3,512,329 | A | 5/1970 | Du Plessis |
| 3,981,601 | A | 9/1976 | Arai |
| 4,196,558 | A | 4/1980 | Jungbluth |
| 4,457,115 | A | 7/1984 | Grearson et al. |
| 4,612,747 | A | 9/1986 | Andra et al. |
| 5,655,349 | A | 8/1997 | Ghali et al. |
| 5,992,123 | A | 11/1999 | Kies |
| 5,996,297 | A | 12/1999 | Keith et al. |

FOREIGN PATENT DOCUMENTS

DE 19819774 A1 * 11/1999 ..... 52/719

* cited by examiner

*Primary Examiner*—Carl D. Friedman
*Assistant Examiner*—Naoko Slack
(74) *Attorney, Agent, or Firm*—David W. Pettis, Jr.

(57) ABSTRACT

A connector used to attach a reinforcing element to a headed stud includes a body uniquely configured to be placed onto the stud's head. The body also includes a pair of opposed apertures such that a reinforcing element such as, for example, a length of rebar, maybe inserted through the apertures such that the connector, already disposed on the stud head, effectively "locks" the reinforcing element to the stud.

8 Claims, 3 Drawing Sheets

MECHANICAL CONNECTOR BETWEEN HEADED STUDS AND REINFORCING STEEL

BACKGROUND OF INVENTION

1. Field of the Invention

The present invention is a connector used to attach a reinforcing element to a headed stud such that a subsequent pour of concrete will effectively "lock" the reinforcing element to the stud, thereby enhancing the strength characteristics of articles poured around the headed studs and reinforcing elements attached thereto, it being understood that the headed studs are typically cast into a structural element extending for the joining of a second poured element thereto.

2. Description of the Prior Art

It is, of course, well known in the construction industry that preformed and pre-stressed concrete structural elements typically include reinforcing elements such as, for example, wire mesh and rebar, embedded within the concrete structural element. The industry has long recognized the necessity of placing the reinforcing elements properly and maintaining those elements in position as the pour is made. In recognition of this necessity, the prior art teaches numerous devices for supporting reinforcing elements and for tying those elements together and to framing and connecting members also embedded into the structural concrete member.

For example, U.S. Pat. No. 1,086,732 discloses a metal tie in the form a clip which has a slot to receive a section of rebar and includes bendable arms to hold one or more additional sections of rebar in a transverse relation to the rebar placed within the slot. Obviously, with such a device, some mechanical force must be applied to bend the tabs into place.

U.S. Pat. No. 2,772,560 discloses a pick-up device that is embedded into pre-cast concrete slabs wherein wires are used to "hook" sections of rebar onto fasteners which are embedded into the slab, exposing eyes above the slab whereby it can be lifted.

Another example of a bendable metal connector is taught in U.S. Pat. No. 3,512,329. The device of this patent is particularly suited for mechanically connecting lengths of rebar disposed at right angles to each other, with the connector of this patent being placed at the intersection.

U.S. Pat. No. 3,981,601 discloses structure for an expansion joint between two concrete structures whereby an embedded connector includes a hook portion that may serve as a cradle for holding rebar as the joint structure is cast in place.

U.S. Pat. No. 4,196,558 teaches a fire-resistant concrete and steel structural element wherein headed studs are provided on a metal I-beam, and concrete is poured around the beam. According to the teaching of this patent, reinforcing elements may be placed across the shaft of adjacent headed studs before the pour is made. However, this patent does not disclose means for ensuring that the reinforcing elements do not move or shift as the pour is made.

Another reinforced concrete structural element is taught in U.S. Pat. No. 5,655,349 wherein a principal reinforcing member is a headed stud, one end of which is retained and an elongate support element that is also contained within the pour. This patent shows the use of reinforcing elements in addition to the plurality of headed studs placed within the elongate track, but no means are disclosed for connecting the reinforcing elements to the stud.

A somewhat similar structure is disclosed in U.S. Pat. No. 5,992,123 in that headed studs placed within an elongate track are embedded in a concrete structural element. According to the disclosure of this patent, reinforcing elements such as lengths of rebar in addition to the stud assembly are used, but the reinforcing elements are not mechanically attached to the stud.

It is also known to attach reinforcing elements such as, for example, wire mesh and lengths of rebar, to connector plates and other such elements embedded within a concrete pour by the use of wires twisted around the reinforcing element and the connector, and even by welding the reinforcing element to the connector. Obviously, both of these procedures, as well as the teachings contained in the prior art discussed above, are labor-intensive and the quality of the connection made is extremely dependent upon the skill and care of the installer.

It is therefore clear that while numerous means for connecting reinforcing elements to a variety of connectors typically embedded in pre-cast and pre-stressed concrete structural elements are known, there remains a great need for a connector that is easy to assemble, that minimizes the likelihood of improper installation, and that requires no external fastener such as wires, clips, bolts, or welding.

SUMMARY OF THE INVENTION

The present invention relates to a connector used to attach a reinforcing element such as, for example, wire mesh or rebar, to a headed stud, it being understood that both the reinforcing elements and the headed studs are embedded within pre-cast or pre-stressed concrete structural elements. The connector of this invention comprises a body of substantially rectangular configuration and including a slot formed through the body extending from a bottom toward the top. A relieved portion is provided on the face of the body, and the relieved portion also extends from the bottom of the body toward the top of the body, with the relieved portion intersecting the slot. By virtue of this structure, the head of a stud may be received into the slot from the bottom of the body, and the shaft or neck of the stud will pass through the relieved portion formed in the front of the body.

The connector further comprises a pair of opposed enlarged portions extending from first and second sides outwardly from the front, with each enlarged portion being spaced outwardly of the relieved portion on the front of the connector body. Corresponding apertures are formed through each of the enlarged portions, and these apertures are dimensioned and configured such that a reinforcing element such as, for example, a length of rebar, may be inserted therethrough. The reinforcing element would be inserted through the apertures after the connector body had been placed on the stud such that the reinforcing element is below the headed stud and effectively "locks" the connector onto the stud and serves to attach the reinforcing element thereto without the necessity of employing any other fastening means.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION OF THE INVENTION

Figure 1:
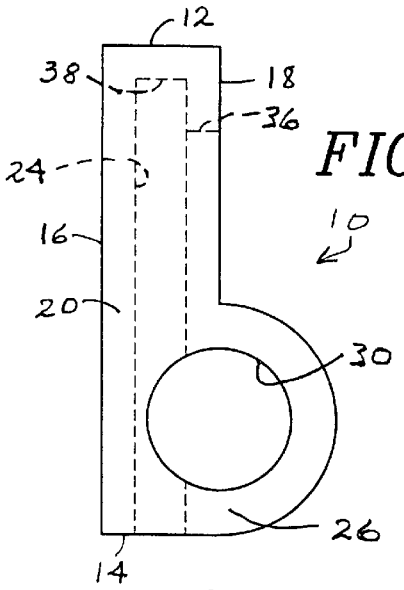
FIG. 1 is a side elevation of the connector of this invention.
Figure 2:
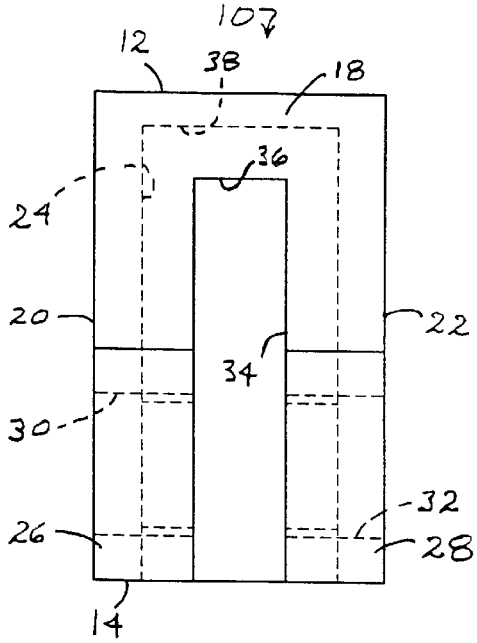
FIG. 2 is a front elevation of the connector.
Figure 4:
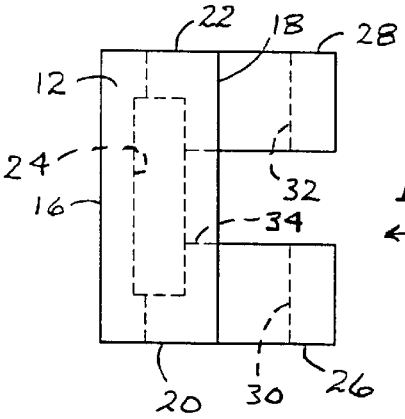
FIG. 4 is a top plan view of the connector.
Figure 5:
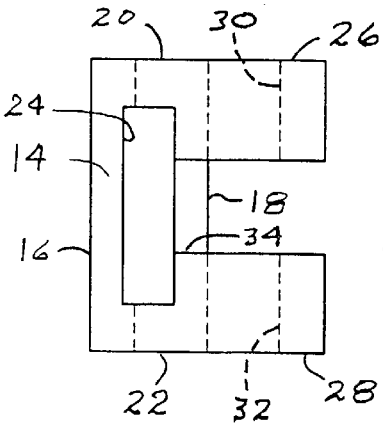
FIG. 5 is a bottom plan view of the connector.
Figure 3:
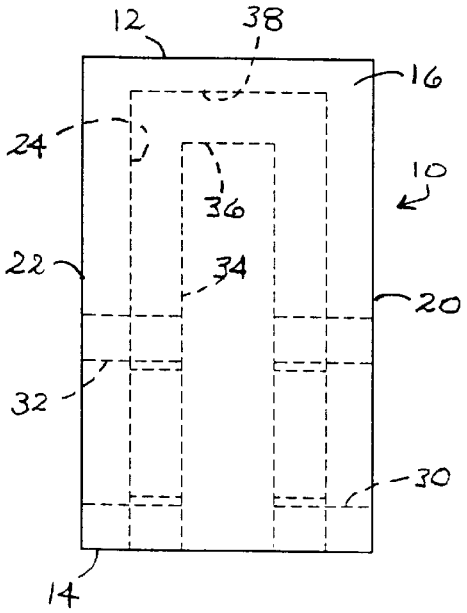
FIG. 3 is a back elevation of the connector.

A preferred embodiment of the connector of this invention is illustrated in the drawing figures and comprises a connector body generally indicated as 10. Referring first to the views of FIGS. 8 and 9, body 10 defines a top 12, a bottom 14, a back 16, a front 18, a first side 20, and a second side 22. Inasmuch as the connector of this invention is used as a mechanical connection in pre-cast and pre-stressed concrete structures, body 10 must be formed from a relatively strong and durable material. Preferably, connector body 10 is cast metal, but the scope of this invention is intended to include other materials such as, for example, plastics, carbon fiber, or other similar materials.

Figure 8:
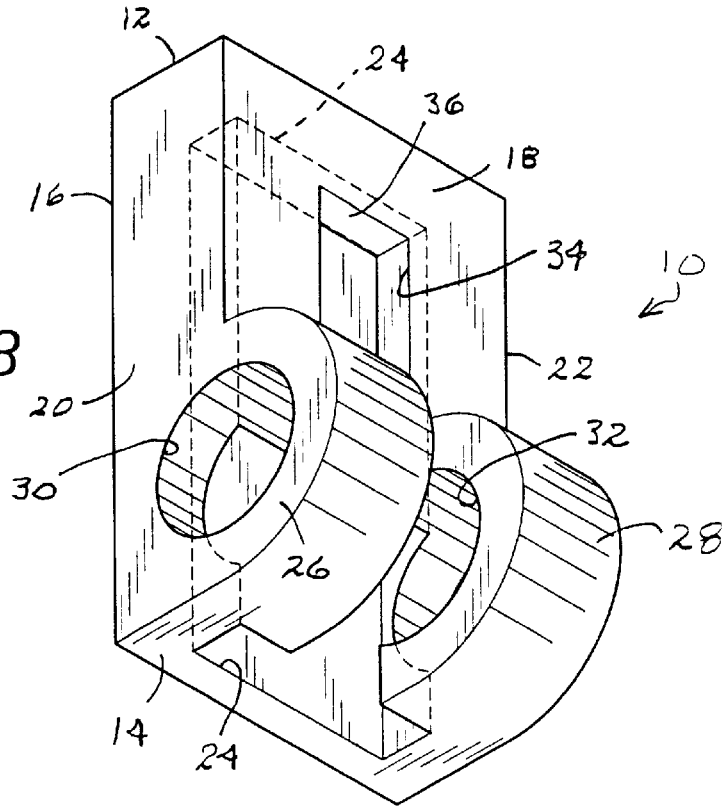
FIG. 8 is a detailed, enlarged view of the connector from a front, bottom perspective.
Figure 9:
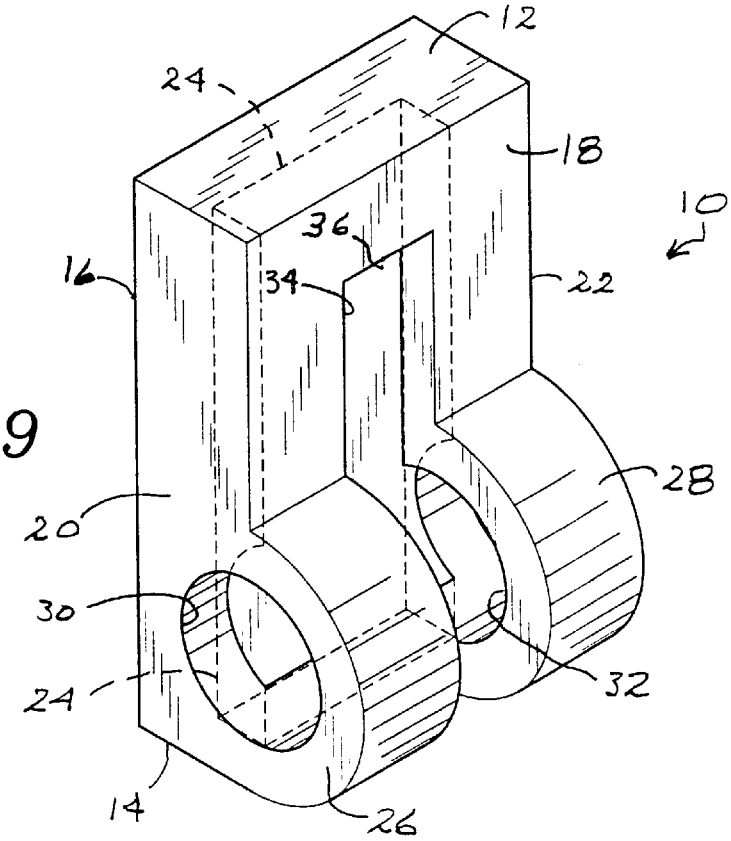
FIG. 9 is a view of the connector shown in FIG. 8 from a front, top perspective.

Still referring to the views of FIGS. 8 and 9, connector body 10 further comprises a slot 24 formed through bottom 14 and extending through body 10 toward top 12. This extension of slot 24 from bottom 14 toward top 12 is, of course, shown in broken lines. One can also see that first side 20 includes a first enlarged portion 26 adjacent bottom 14 and extending outwardly from front 18. A corresponding second enlarged portion 28 is provided on second side 22. A first aperture 30 is formed through first enlarged portion 26, and a corresponding second aperture 32 is formed through second enlarged portion 28. It is also to be noted that while in this embodiment first enlarged portion 26 and second enlarged portion 28 are both illustrated as being rounded as they extend outwardly from front 18, this particular configuration is not limiting to the scope of this invention. Virtually any shape or configuration for enlarged portions 26 and 28 could be utilized so long as they define sufficient material for their respective first and second apertures 30 and 32.

Finally, one can see that a relieved portion 34 is formed in front 18 between first side 20 and second side 22. Relieved portion 34 extends from bottom 14 toward top 12 and intersects slot 24 along the length defined between bottom 14 and terminus 36 of relieved portion 34.

Figure 6:
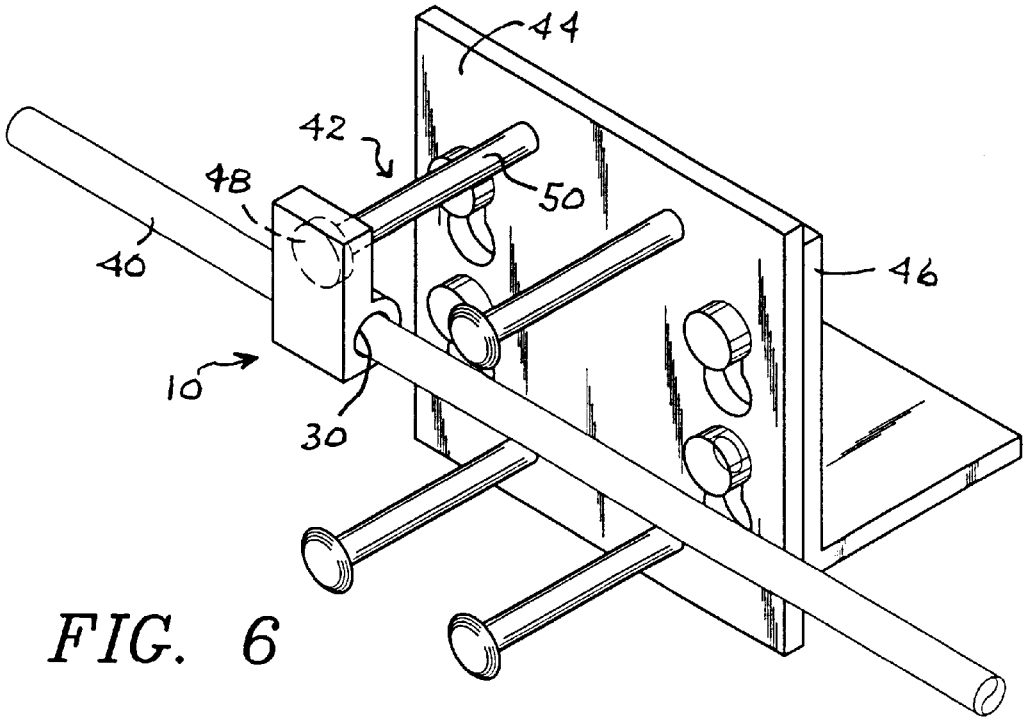
FIG. 6 is a rear view showing attachment of the connector to a headed stud with a reinforcing element in place.
Figure 7:
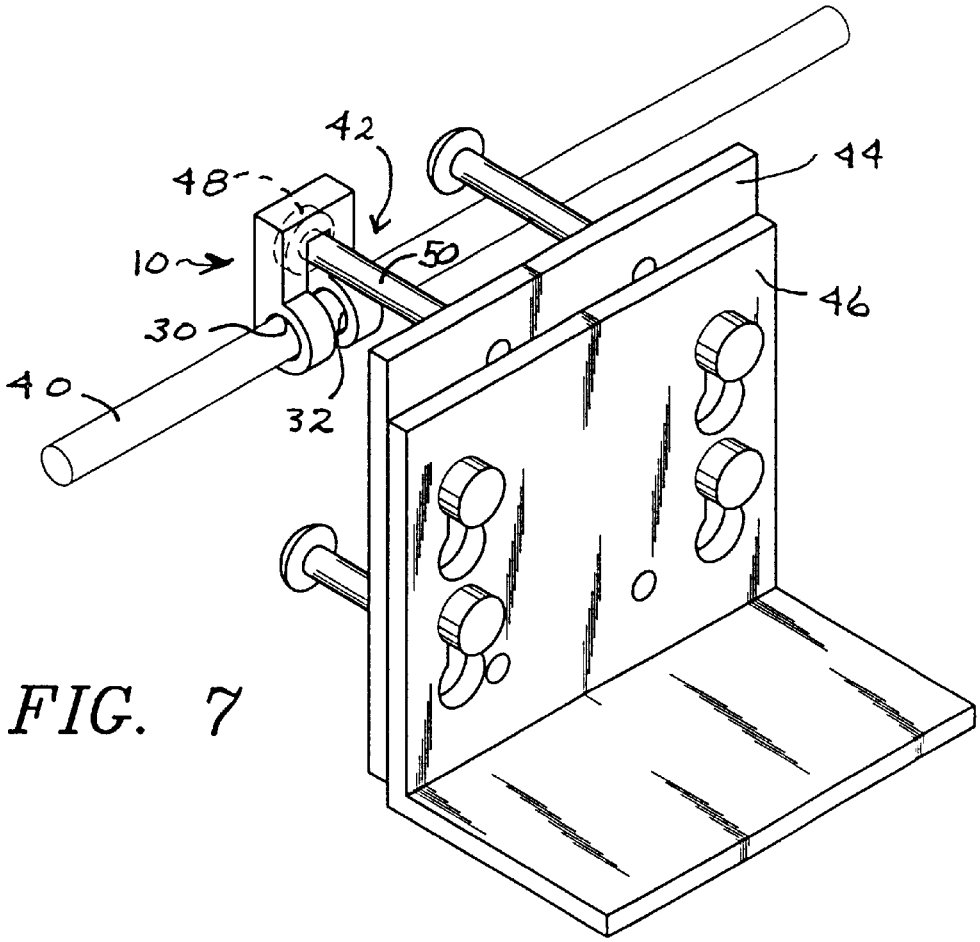
FIG. 7 is a front view of the assembly as shown in FIG. 6.

Turning to the views of FIGS. 1–5, inclusive, this preferred construction for connector body 10 is shown in the various elevational and plan views of those figures. Referring more particularly to the view of FIG. 2, one can see that slot 24 defines a length between bottom 14 and terminus 38 of slot 24, and that this length is greater than the corresponding length of relieved portion 34. One can also see that the width of slot 24, as measured between first side 20 and second side 22, is greater than the corresponding width of relieved portion 34. Turning now the views of FIGS. 6 and 7, illustrations are provided showing the use of the connector of this invention for attaching a reinforcing element 40 to a headed stud generally indicated as 42. The views of FIGS. 6 and 7 depict an attachment plate 44 from which the headed studs 42 extend, and a receiver plate 46 onto which attachment plate 44 may be mounted. Though not shown in these figures, it is to be understood that, according to known construction principles and techniques, receiver plate 46 would typically be embedded along one edge of a cementitious structural element, and attachment plate 44, with a plurality of reinforcing elements 40 in place, would be cast into another cementitious structural element to be joined to that element including receiver plate 46. It is also to be understood that while only a single connector body 10 and reinforcing element 40 are illustrated in the views of FIGS. 6 and 7, a typical installation would comprise a plurality of these devices. Furthermore, and as previously stated, while the illustrated reinforcing element 40 is shown as an elongate, rounded bar, this certainly is not to be interpreted as a limitation to the scope of the present invention.

In use, one first attaches connector body 10 to headed stud 42 by inserting stud head 48 into slot 24 with stud shaft 50 therefore extending through relieved portion 34. Then, one inserts reinforcing element 40 through the first and second apertures 30 and 32, respectively. Because relieved portion 34 defines a width that is narrower than the corresponding width of slot 24, stud head 48 is retained within slot 24 of connector body 10. In like fashion, once reinforcing element 40 is inserted through first and second apertures 30 and 32, connector 10 effectively "locks" reinforcing element 40 in position with respect to attachment plate 44.

It will thus be seen that the objects set forth above, among those made apparent from the preceding description, are efficiently attained, and since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Now that the invention has been described,

What is claimed is:

1. A connector used to attach a reinforcing element to a headed stud, said connector comprising: a connector body, said connector body having a top, a bottom, a back, a front, a first side, and a second side; a slot being formed through said bottom and extending through said connector body toward said top, said slot being dimensioned to receive the head of the headed stud therein; said first side having a first enlarged portion adjacent said bottom and extending outwardly from said front; said second side having a second enlarged portion adjacent said bottom and extending outwardly from said front; a first aperture formed through said first enlarged portion and a second aperture formed through said second enlarged portion in opposed relation to said first aperture, each of said first and second apertures being dimensioned to receive the reinforcing element therethrough; and a relieved portion formed in said front between said first and second sides and extending from said bottom toward said top, said relieved portion intersecting said slot and being dimensioned to receive the stud therein, whereby said connector may be attached to the headed stud and the reinforcing element may be inserted through said first and second apertures.

2. A connector as in claim 1 wherein said slot defines a width between said first and second sides that is greater than the width between said first and second sides of said relieved portion in said front.

3. A connector as in claim 1 wherein said slot defines a length between said bottom and a terminus of said slot adjacent said top that is greater than a length between said bottom and a terminus of said relieved portion adjacent said top.

4. A connector as in claim 3 wherein said terminus of said slot is closer to said top than is said terminus of said relieved portion.

5. A connector used to attach a reinforcing element to a headed stud, said connector comprising: a connector body, said connector body having a top, a bottom, a back, a front, a first side, and a second side; a slot being formed through said bottom and extending through said connector body toward said top, said slot being dimensioned to receive the head of the headed stud therein and said slot having a slot length defined by the distance between said bottom and a terminus of said slot adjacent said top; said first side having a first enlarged portion adjacent said bottom and extending outwardly from said front; said second side having a second enlarged portion adjacent said bottom and extending outwardly from said front; a first aperture formed through said first enlarged portion and a second aperture formed through said second enlarged portion in opposed relation to said first aperture, each of said first and second apertures being dimensioned to receive the reinforcing element therethrough; and a relieved portion formed in said front between said first and second sides and extending from said bottom toward said top, said relieved portion having a relieved portion length defined by the distance between said bottom and a terminus of said relieved portion adjacent said top, said relieved portion intersecting said slot and being dimensioned to receive the stud therein, whereby said connector may be attached to the headed stud and the reinforcing element may be inserted through said first and second apertures.

6. A connector as in claim 5 wherein said slot defines a width between said first and second sides that is greater than the width between said first and second sides of said relieved portion in said front.

7. A connector as in claim 5 wherein said terminus of said slot is closer to said top than is said terminus of said relieved portion.

8. A connector used to attach a reinforcing element to a headed stud, said connector comprising: a connector body, said connector body having a top, a bottom, a back, a front, a first side, and a second side; a slot being formed through said bottom and extending through said connector body toward said top, said slot being dimensioned to receive the head of the headed stud therein and said slot having a slot length defined by the distance between said bottom and a terminus of said slot adjacent said top; said first side having a first enlarged portion adjacent said bottom and extending outwardly from said front; said second side having a second enlarged portion adjacent said bottom and extending outwardly from said front; a first aperture formed through said first enlarged portion and a second aperture formed through said second enlarged portion in opposed relation to said first aperture, each of said first and second apertures being dimensioned to receive the reinforcing element therethrough; a relieved portion formed in said front between said first and second sides and extending from said bottom toward said top, said relieved portion having a relieved portion length defined by the distance between said bottom and a terminus of said relieved portion adjacent said top, said relieved portion intersecting said slot and being dimensioned to receive the stud therein; and said slot defining a width between said first and second sides that is greater than the width between said first and second sides of said relieved portion in said front, whereby said connector may be attached to the headed stud and the reinforcing element may be inserted through said first and second apertures.

* * * * *